United States Patent [19]

Butler

[11] 4,184,366

[45] Jan. 22, 1980

[54] COIN TESTING APPARATUS

[76] Inventor: Frederick R. Butler, 8 Lancaster Ride, Penn, High Wycombe, Buckinghamshire, HP10 8DU, England

[21] Appl. No.: 918,805

[22] Filed: Jun. 26, 1978

Related U.S. Application Data

[63] Continuation of Ser. No. 804,776, Jun. 8, 1977, abandoned.

[30] Foreign Application Priority Data

Jun. 8, 1976 [GB] United Kingdom ..... 23672/76

[51] Int. Cl.[2] ..... G07F 3/02

[52] U.S. Cl. ..... 73/163; 194/100 A; 194/102

[58] Field of Search ..... 73/163; 194/100 R, 100 A, 194/102; 324/61 R, 61 P; 209/571

[56] References Cited

U.S. PATENT DOCUMENTS

| | | | |
|---|---|---|---|
| 3,901,368 | 8/1975 | Klinger | 73/163 |
| 3,977,508 | 8/1976 | Baumberger | 194/100 A |

FOREIGN PATENT DOCUMENTS

| | | | |
|---|---|---|---|
| 1401488 | 4/1965 | France | 194/100 A |

*Primary Examiner*—S. Clement Swisher

[57] ABSTRACT

A coin testing apparatus is designed to accept and test a plurality of different coins, for example some or all of the coins of a particular currency. The apparatus stops an inserted coin in a predetermined position and tests its diameter, composition and thickness. It may also test its weight. Only if an inserted coin, (or object purporting to be a coin,) passes all of these tests will it be accepted. To test the diameter, the inserted coin serves as one electrode of a capacitor. The coin rests by gravity against an inclined board of dielectric material, on the other side of which a plurality of arcuate electrodes are arranged such that, for a coin of predetermined diameter, one electrode will be opposite a position outside the periphery of the coin and another will be opposite a position inside the periphery. The presence of a coin of predetermined diameter will cause a substantial change in the capacity between the coin and said other electrode and is indicated by the capacities between the two electrodes and the coin differing by more than a predetermined value. The composition check involves disposing a coin in an air gap of a single magnetic core having a coil wound thereon. The coil forms part of a tuned circuit of an oscillator whereby each of the plurality of acceptable coins, when present in the air gap, causes the oscillator to operate at a respective different frequency. The thickness check is carried out by monitoring the capacitance between the coin, resting against the inclined board, and a further electrode.

13 Claims, 8 Drawing Figures

COIN COMPOSITION MONITORING CIRCUIT (FIG. 6.)
92
COIN THICKNESS MONITORING CIRCUIT (FIG. 7.)
120
70'
106
108
110
112
134
136
130
132
172
70
70
70
70
70
COMPARATOR
164
166
168
170
MAIN LOGIC CIRCUIT
150
174
176
178
180
34
CAPACITATIVE SENSOR
158
MONO
160
MONO
162
MONO
152
ACCEPT FLAP (32) SOLENOID
154
REJECT FLAP (28) SOLENOID
156
CAPACITATIVE ACCEPT FLAP (32) POSITION SENSOR
36
CAPACITATIVE SENSOR

COIN TESTING APPARATUS

This is a continuation of application Ser. No. 804,776, filed June 8, 1977 now abandoned.

BACKGROUND OF THE INVENTION

1. Field of the Invention

This invention relates to coin testing apparatus which may be used, for example, to test coins tendered for the operation of vending machines, telephone coin-boxes or other coin-freed apparatus.

2. Description of the Prior Art

Coin testing apparatus is known. Earlier apparatus was essentially mechanical in operation and therefore complex, expensive to manufacture, and not very reliable. More recently, electronic coin testing apparatus has become available. Electronic apparatus now on the market is subject to a number of disadvantages. One such disadvantage is that the apparatus is designed to test coins on the move, which means that the apparatus must be of relatively complex design. A known electronic apparatus employs light emitting diodes (LEDs) and photosensors in carrying out checks on coins. A disadvantage of this arrangement is that dirt tends to gather on the LEDs thereby blocking the emission of light, whereby the apparatus fails to function correctly and has to be stripped down and cleaned.

OBJECTS OF THE INVENTION

One object of the invention is to provide a simple and reliable electronic coin testing apparatus.

Another object of the invention is to provide a coin testing apparatus in which coins to be tested are stopped while a testing operation is carried out, thereby simplifying the design of the apparatus.

A further object of the invention is to provide a coin testing apparatus in which the operative testing elements are not directly exposed to coins to be tested, whereby dirt from the coins cannot accumulate thereon to adversely affect operation.

SUMMARY OF THE INVENTION

The inventive apparatus carries out a capacitative test of the diameter of the inserted coin. To this end, the apparatus comprises a member of dielectric material having a first surface against which in use, a coin can rest, at least two spaced electrodes disposed on a second surface of the member opposite the first surface and positioned such that when a coin of predetermined diameter rests against the first surface in a predetermined position a first of the electrodes will be opposite a position on the first surface within the periphery of the coin and a second of the electrodes will be opposite a position on the first surface outside of the periphery of the coin, a planar conductive member arranged on the second surface, and capacitance monitoring means connected to the first and second electrodes and operative to monitor the capacities between the first and second electrodes and the planar conductive member and responsive to the capacities differing by more than a predetermined amount to provide an output signal indicating that a coin of the predetermined diameter is in the predetermined position.

The apparatus may be designed to test only for coins of one predetermined diameter, in which case only two electrodes are needed. Normally, however, the apparatus will be designed to test coins of a plurality of different predetermined diameters, for example some or all of the coins of a particular currency (e.g. U.S., British, French, Canadian, Japanese, etc). In this case the number of and positioning of the electrodes will be such that, for each predetermined coin diameter, two of the electrodes will be disposed as set forth above.

In a preferred apparatus embodying the invention and described in detail below, composition and thickness tests are carried out as well as the diameter check set forth above. As will be evident, a particular coin in a particular currency will generally be of a predetermined diameter, composition and thickness. All three tests are carried out while a coin is stopped in the said predetermined position. Output signals provided as a result of all three tests are passed to gating circuitry. Only if the three output signals indicate that the diameter, composition and thickness all correspond to a particular type of coin for which the apparatus is designed to test will the gating circuitry enable acceptance of the coin.

BRIEF DESCRIPTION OF THE DRAWINGS

The invention will now be further described, by way of example, with reference to the accompanying drawings, in which.

DETAILED DESCRIPTION OF THE PREFERRED EMBODIMENT

Figure 1:
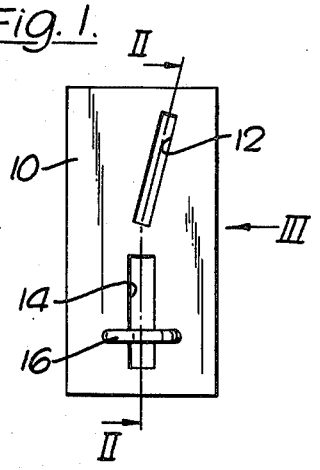
FIG. 1 is a partial front view of a coin testing apparatus embodying the invention.
Figure 2:
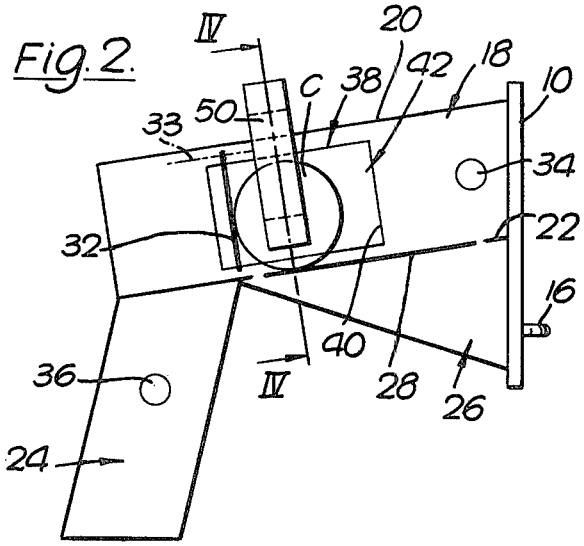
FIG. 2 is a somewhat schematic side view of the structure depicted in FIG. 1, the view being mainly sectional along the line II—II in FIG. 1.

Referring first to FIGS. 1 to 4 of the drawings, the illustrated apparatus comprises a face place 10 having therein a coin insertion slot 12 and a coin reject slot 14 provided with a bar 16 for holding rejected coins in place. Extending from the coin insertion slot is a coin runway 18 constituted by a wall 20 and by a floor 22. The runway 18 is not only inclined downwardly, but is also inclined to one side so that the wall 20 is inclined with respect to a vertical plane. A coin accept chute 24 extends downwardly from the lower end of the runway 18. A coin reject chute 26 leads downwardly from a position part way along the runway 18 to the coin reject slot 16. Part of the floor 22 of the runway 18 is constituted by a coin reject flap 28 pivotable out through the side of the runway about an axis parallel to the runway from a closed position shown in FIG. 4 to an open position in which the runway is open to the reject chute 26. A coin accept flap 32 is disposed in the runway 18 and is pivotable out of the side of the runway about an axis 33 (FIG. 2) parallel to the runway from a closed position shown in FIG. 2 to an open position opening the runway to the accept chute 24. With the accept flap 32 in the closed position, a coin C inserted through the slot 12 will roll down the runway 18 and be stopped in the position shown in FIGS. 2 and 3 when it abuts the accept flap. The rim of the coin is then in contact with the reject flap 28. If, then, the accept flap 32 is pivoted to its open position the coin will roll on and drop down the accept chute 24, whereas if, instead, the reject flap 28 is pivoted to its open position, the coin will roll down the reject chute 26 and emerge from the reject slot 14 to be retained by the bar 16.

A capacitative sensor 34 (FIG. 2) is mounted just inside the runway 18. A second capacitative sensor 36 (FIG. 2) is mounted inside the accept chute 24.

A board 38 of dielectric (i.e. non-conductive) material, for instance glass fibre, is let into a correspondingly shaped aperture 40 in the wall 20 of the runway 18 so that one surface 42 thereof is flush with the inner side of the wall 20. The board 38 is, as shown, disposed at the above-mentioned stopping position of the coin C, so that the coin rests, under the effect of gravity, against the inclined surface 42 of the board 38.

The surface 44 of the board 38 opposite the surface 42 has etched or printed thereon a group of five spaced arcuate metallic electrodes 46. Each electrode 46 is in the form of a strip approximately 1 mm wide (in the radial sense) and 2 mm long (in the circumferential sense). A further arcuate metallic reference electrode 48 is also etched or printed on the surface 44, in this case near the accept flap 32. The remainder of the surface 44 is provided with a metallic coating 49 connected to ground to constitute a ground plane shown cross-hatched in FIG. 3, the coating being spaced from each of the electrodes 46 and 48 by about 1 mm.

Figure 3:
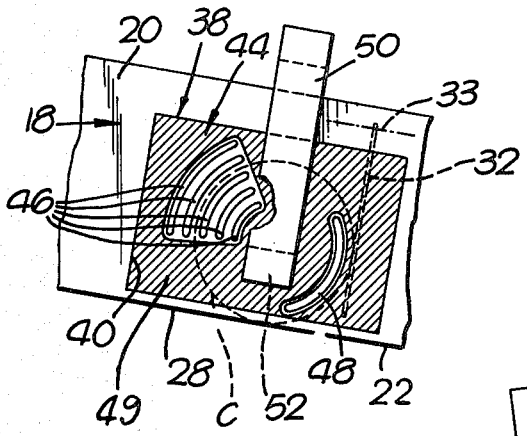
FIG. 3 is a side view, taken in the direction of the arrow III in FIG. 1, of part of the structure shown in FIGS. 1 and 2.

The number and positioning of the electrodes 46 is determined in accordance with the diameters of predetermined coins to be tested by the apparatus such that the periphery of each coin will, when the coin is stopped against the accept flap 32, be disposed opposite and between two of the electrodes 46, as shown in FIG. 3. In other words, for each predetermined coin diameter, at least one of the electrodes 46 will be opposite a position on the surface 42 within the periphery of the coin and at least one other of the electrodes 46 will be opposite a position on the surface 42 outside of the periphery of the coin. The present apparatus is arranged to distinguish between coins of four different diameters, whereby at least five electrodes 46 are needed.

Figure 4:
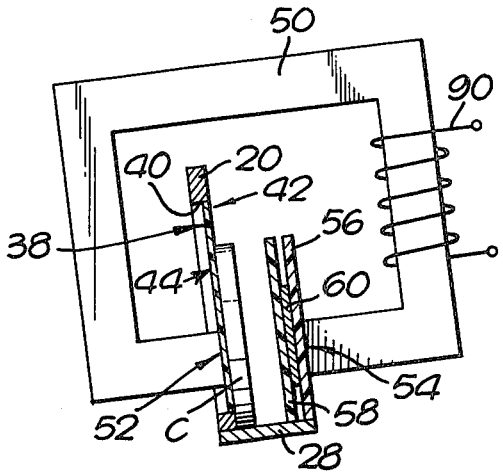
FIG. 4 is a section along the line IV—IV in FIG. 2.

A magnetic core 50, the shape of which can best be appreciated from FIG. 4, is disposed at the above-described stopping position of the coin C. The core 50 has an air gap defined between surfaces 52, 54 thereof. The surface 52 abuts the surface 44 of the board 38. The surface 54 confronts the surface 52 such that the entire air gap will extend through any coin of permitted size stopped at the above-described stopping position.

A sheet 56 of non-conductive material (for instance glass fibre) abuts the surface 54 of the air gap. Another sheet 58 of non-conductive material (for instance glass fibre) lies against the sheet 56 to form a wall of the runway 18 opposite the wall 20. A circular metallic electrode 60 is etched or printed on the side of the sheet 58 adjacent the sheet 56 so as to be sandwiched between the sheets 56 and 58.

Figure 5:
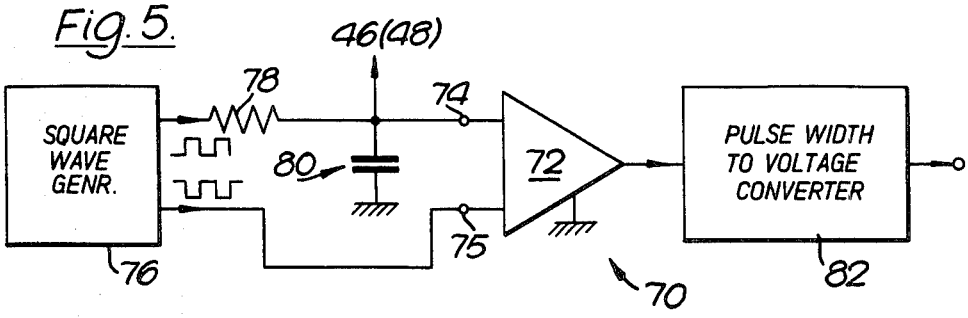
FIG. 5 is a schematic circuit diagram of a capacitance monitoring circuit forming part of the apparatus embodying the invention.

A respective, like capacitance monitoring circuit is connected to each of the electrodes 46 and 48. The capacitance monitoring circuit for one of the electrodes 46, 48 is shown generally at 70 in FIG. 5. The capacitance monitoring circuit comprises a C/MOS gate 72 operating as a Schmitt trigger and having two inputs 74, 75. A square wave generator 76, which may be common to all six of the capacitance monitoring means 70, is connected to the inputs 74, 75 to supply thereto square waves of respective opposite phases. The input 74 is supplied via a series resistor 78. The input 74 is connected to the associated electrode 46 or 48, whereby the capacity to ground of the electrode, shown schematically as a capacitor 80, is connected in circuit as shown in FIG. 5, whereby the resistor 78 and capacitor 80 constitute an RC timing network. As is known to those skilled in the art, the arrangement described so far constitutes a monostable circuit in that the gate 72 produces a pulse at its output on each alternate occasion that the square wave input changes level, the width of the pulse being dependent upon the time constant of the RC network, that is to say upon the capacity of the electrode 46 or 48 to ground. A pulse width to voltage converter 82 converts the pulse width to a voltage proportional to the pulse width and therefore also proportional to the capacity to ground of the associated electrode 46 or 48.

It will be appreciated that when a coin is not present at the abovementioned stopping position, the capacity to ground of each of the electrodes 46, 48 will be relatively low. When a coin stops at this position, by virtue of the fact that the capacitance between the coin and the ground plane 49 is at least ten times greater than the capacitance between the coin and any electrode 46, 48 disposed opposite a position within the periphery of the coin, whereby the coin is effectively AC grounded, and the coin is spaced opposite at least some of the electrodes, the capacities to ground of at least some of the electrodes will increase substantially. In all cases, provided the coin has not for some reason stopped short of the accept flap 32, the capacity to ground of the electrode 48 will increase substantially. The capacities to ground of those of the electrodes 46 disposed opposite positions within the periphery of the coin will, of course, increase by more than the capacities to ground of the other electrodes 46. Therefore, by comparing the voltages provided by the capacitance monitoring circuits 70 and noting if the capacitances between any two adjacent electrodes 46 differ by more than a predetermined amount one can determine if the diameter of a coin is within a narrow range of values such that it is between the adjacent electrodes and is therefore of a diameter lying within a narrow range corresponding to one of the four acceptable coins. Such comparison operation will be described in more detail hereinbelow.

The magnetic core 50 described above has a coil 90 wound thereon. The core 50 and coil 90 form part of a coin composition monitoring circuit shown generally at 92 in FIG. 6. The coil 90 cooperates with a capacitor 94 to form a tuned circuit determining the operating frequency of an oscillator 96. When a coin comes to rest at the stopping position described above, where it is disposed in the air gap of the core 50, the inductance of the coil 90 will change by an amount dependent upon the composition of the coin. Two factors are involved: the permeability of the coin material affects the magnetic flux produced by the coil 90 and flowing around the core 50 and across the air gap, and the resistivity of the coin material affects eddy current losses in the coin. Some of the four types of coin may, of course, be of the same composition. However, since coins of the same composition but of different denominations may also be of different thicknesses, each of the four coins will, it is found, cause the oscillator 96 to operate within a respective one of four narrow frequency ranges.

The nominal or basic operating frequency of the oscillator is chosen to be sufficiently low (e.g. about 400 Hz) so that even the thickest coin to be tested will be completely permeated by the magnetic field of the core 50 traversing the air gap, so that skin effect does not need to be considered.

The output of the oscillator 96 is passed through a frequency to voltage converter 98, a low pass filter 100 for removing parasitic voltages, and a DC amplifier 102. The output of the amplifier 102 will be a DC voltage of a level corresponding to the operating frequency of the oscillator 96, and is passed to four threshold gates 104. Each gate 104 is responsive to the voltage from the amplifier 102 lying within a respective narrow predetermined range of values corresponding to a respective one of the four coin types being in the air gap to provide an output signal indicating such on one of four output leads 106, 108, 110 and 112.

Figure 7:
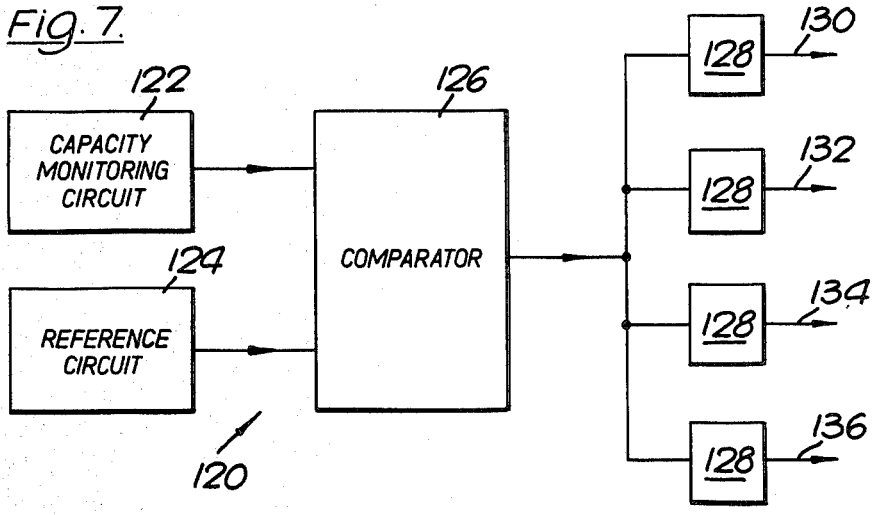
FIG. 7 is a schematic circuit diagram of a coin thickness monitoring circuit forming part of the apparatus embodying the invention.

When a coin reaches the above-described stopping position, it will be evident that the capacitance to ground of the electrode 60 (FIG. 4) will be changed by an extent proportional to the thickness of the coin, the capacitance between the coin and ground (the ground plane 49) being at least ten times greater than the capacitance between the electrode 60 and the coin whereby the coin is effectively AC grounded. Advantage is taken of this phenomenon to monitor the thickness of the coin. The thickness monitoring circuit used to perform this task is shown generally in FIG. 7 at 120. A voltage proportional to the capacitance to ground of the electrode 60 and therefore to the thickness of the coin is produced in a capacity monitoring circuit 122. The circuit 122 can be substantially exactly the same as the circuit 70 described with reference to FIG. 5 except that, of course the capacitor 80 will in this case represent the capacity to ground of the electrode 60. The thickness monitoring circuit 120 further includes a reference circuit 124, which is substantially the same as the circuit 122 except that it monitors the capacitance to ground of a further electrode (not shown) in the apparatus. The two voltages from the circuits 122 and 124 are compared in a comparator 126 which may essentially comprise a differential amplifier. An advantage of the reference circuit 124 is that undesired effects such as parasitic voltages, drift or the like substantially equally affect the capacities measured by the two circuits 122 and 124 so that such effects are substantially cancelled out in the comparator 126. The output voltage from the comparator 126, which is proportional to the capacity to ground of the electrode 60 and therefore to the thickness of the coin under test, is passed to four threshold gates 128. Each gate 128 is responsive to the voltage from the comparator 126 lying within a respective narrow predetermined range of values corresponding to the thickness range of a respective one of the four types of coin to provide an output signal indicating the coin type on one of four output leads 130, 132, 134 and 136.

Figure 8:
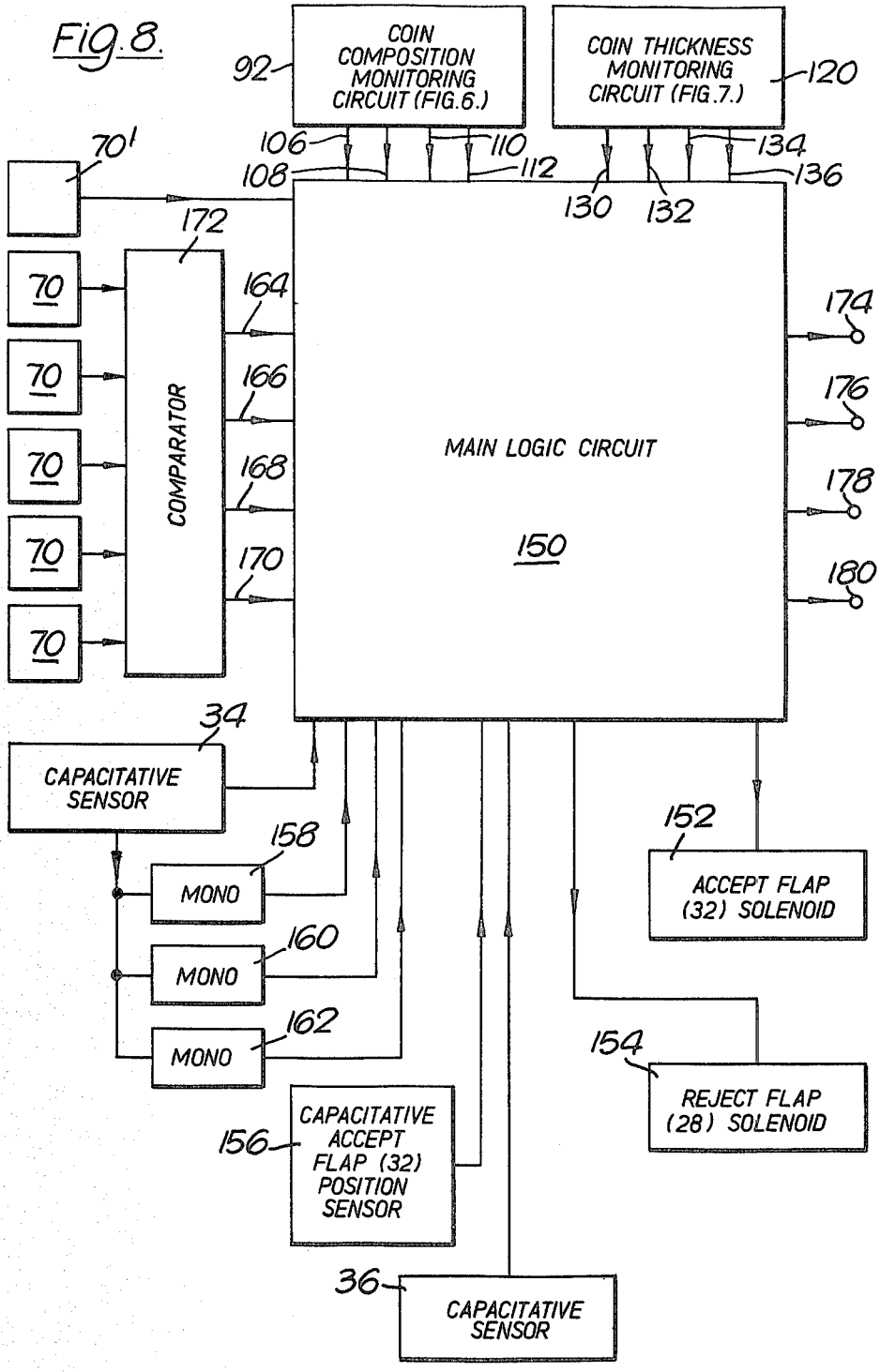
FIG. 8 is an overall block diagram of the apparatus.

An overall block diagram of the apparatus is shown in FIG. 8. A main logic circuit 150, described below, has connected thereto, as shown, the coin composition monitoring circuit 92 of FIG. 6, the coin thickness monitoring circuit 120 of FIG. 7, the capacitative sensors 34 and 36, solenoids 152 and 154 for operating the coin accept flap 32 and coin reject flap 28, respectively, a capacitative sensor 156 for sensing the position of the accept flap 32, respective monostable circuits 158, 160 and 162 each triggered by the capacitative sensor 34, leads 164, 166, 168 and 170 connected to a comparator 172, and output terminals 174, 176, 178 and 180. The five of the capacitance monitoring circuits 70 connected to the respective five electrodes 46 are connected to the comparator 172. The capacitance monitoring circuit connected to the reference electrode 48, referenced 70' in FIG. 8, is also connected to the main logic circuit 150.

The comparator 172 receives the above-described capacitance-dependent voltages from the circuits 70 and carries out the above-described function of determining if the capacitances between any two adjacent electrodes 46, as represented by the voltages from the circuits 70, differ by more than a predetermined amount to indicate the presence of a coin of one of the four predetermined diameters. The comparator 172 may thus essentially comprise four differential amplifiers each connected to an adjacent pair of the circuits 70. The comparator 172 signals detection of a coin of one of the four predetermined diameters by applying an output signal to one of the four leads 164, 166, 168 and 170 leading to the main logic circuit 150.

The main logic circuit 150 principally comprises gating circuitry (not shown) connecting the leads from the monitoring circuits 92 and 120 and from the comparator 172 to the output terminals 174, 176, 178 and 180. The gating circuitry essentially comprises four three-input AND gates. The monitoring circuits 92, 120 and the comparator 172 apply signals to the leads 106, 130 and 164, respectively, if by their respective associated tests each indicate that a coin of the same one of the four types has been inserted. One of the three-input AND gates receives inputs from these leads and applies a signal to the output terminal 174 only if all three tests agree on the type of coin. The other three three-input AND gates are connected such that signals are provided on the output terminals 176, 178 and 180 only if all three tests agree that a coin of the second, third or fourth type, respectively, has been inserted.

The main logic circuit 150 also includes power supply control circuitry and an inhibit circuit, the nature of which will become apparent from the following.

The apparatus described above functions as follows. A coin to be tested is inserted into the insertion slot 12 in the face plate 10, drops on to the runway 18, and starts to roll down the runway. The capacitative sensor 34 senses passage of the coin and triggers the three monostable circuits 158, 160 and 162 to produce pulses having respective durations of approximately 150 ms, 400 ms and 1.5 s. Immediately it detects a coin, provided the accept flap 32 is in the closed position the capacitative sensor 34 is operative on the reject flap solenoid 154 to close the reject flap 28. Energisation of the circuitry is delayed while the monostable circuit 158 is operative to allow sufficient time for the flap to be closed so that movement of the flap will not unsettle the circuitry monitoring changes in capacity. (If a non-conductive disc (i.e. of plastics) is fraudulently inserted the capacitative sensor 34 is not operative as set forth above and the disc is therefore immediately rejected.)

If not rejected, the coin continues rolling down the runway 18, supported on the reject flap 28, until it is stopped by the accept flap 32. The coin then rests, as explained above, against the surface 42 of the board 38. At the termination of the pulse from the monostable circuit 160, which provides sufficient time for the coin to settle in place, the diameter, material composition and thickness of the coin are tested as explained above, provided that the circuit 70' connected to the reference electrode 48 indicates that the coin is properly positioned against the accept flap 32. If the detected values of these three parameters all fall within the ranges indicated that a coin of the same one of the four acceptable types is detected, as signified by an output from any one of the four three-input AND gates in the main logic circuit 150, the solenoid 152 is caused to open the accept flap 32 so that the coin continues down the runway 18 and drops into the accept chute 24. The coin then drops past the capacitative sensor 36 and out of the accept chute 24 into the cash box of equipment controlled by the apparatus. Energisation of the capacitative sensor 36 by the coin dropping therepast enables the appropriate one of the three-input AND gates to pass its output to the appropriate one of the output terminals 174, 176, 178 and 180 of the main logic circuit 150 to signify that a coin of the appropriate one of the four coin types has been unanimously detected by the tests and that the coin has been accepted.

The above-mentioned inhibit circuit in the main logic circuit 150 is triggered in the event that all of the tests do not signify that a coin of one type is present. When triggered, for this reason the inhibit circuit prevents opening of the accept flap 32 and causes the solenoid 154 to open the reject flap 28 to reject the coin. The inhibit circuit is also triggered if the electronic validation and acceptance procedure has not been completed by the end of the period of the monostable circuit 162 and/or if another coin passes the capacitative sensor 34 prior to the end of the period of the monostable circuit 162. If the accept flap is already open when the inhibit circuit is triggered it will remain open until the inhibit circuit is reset. In this situation, the coin which has been tested will either proceed to the accept chute 24 or will roll into the reject chute 26. The inhibit circuit is reset at the end of the period of the monostable circuit 162.

The invention can of course be embodied in other ways than that described above by way of example. For instance, it is possible to alter the number and positioning of the electrodes 46, as mentioned above, to cater for any number of coin types from one up. The diameter and thickness testing arrangements could, likewise, be altered to cater for any number of coin types from one up. Further, an additional test, for example a weight test, could be employed and validated together with the other tests. For example, the coin could be arranged to rest on a strip of piezoelectric ceramic material, the voltage output of which would indicate the weight of the coin.

The validated output signals on the leads 174, 176, 178 and 180 of the main logic circuit 150 can be applied to a variety of uses. For instance, the signals could, if required, be supplied to an electronic or electromechanical accumulator arranged to add the total amount of money accepted by the apparatus in any one sequence of operation. The accumulator could be pre-programmed, for example by means of manual switches, to initiate or enable various operations of equipment controlled by the coin testing apparatus as different money totals are reached.

If the acceptable coin types include coins of greatly differing diameters, it may be necessary to provide at least the further reference electrode 48.

Figure 6:
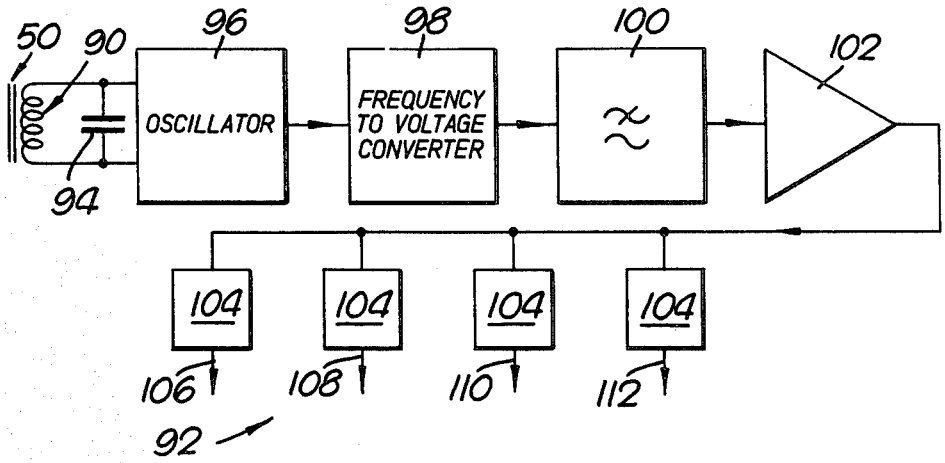
FIG. 6 is a schematic circuit diagram of a coin composition monitoring circuit forming part of the apparatus embodying the invention.

The composition monitoring circuit of FIG. 6 may be modified to monitor percentage changes in the oscillator frequency produced by a coin rather than the absolute value to which the frequency is changed by a coin, whereby it is not necessary to adjust the basic operating frequency of the oscillator 96 to a fixed value, thereby simplifying setting up of the apparatus. Similarly, the thickness and diameter monitoring arrangements could be modified to monitor percentage changes of capacitance on arrival of a coin rather than absolute values to which capacitances are changed.

I claim:

1. A coin testing apparatus comprising:

a member of dielectric material having a first surface against which, in use, a coin can rest;

at least two spaced electrodes disposed on a second surface of said member opposite said first surface and positioned such that when a coin of predetermined diameter rests against the first surface in a predetermined position a first of said electrodes will be opposite a position on the first surface within the periphery of the coin and a second of said electrodes will be opposite a position on the first surface outside of the periphery of the coin;

a planar conductive member arranged on said second surface; and capacitance monitoring means connected to said first and second electrodes and operative to monitor the capacities between said first and second electrodes and said planar conductive member and responsive to said capacities differing by more than a predetermined amount to provide an output signal indicating that a coin of said predetermined diameter is in said predetermined position.

2. A coin testing apparatus according to claim 1, wherein said first surface is inclined to the vertical whereby a coin can rest thereagainst by the effect of gravity.

3. A coin testing apparatus according to claim 1, wherein said electrodes are arcuate.

4. A coin testing apparatus according to claim 1, including means operative to stop a coin in said predetermined position during operation of said capacitance monitoring means.

5. A coin testing apparatus according to claim 1, wherein said capacitance monitoring means comprises generator means to generate electrical signals respectively representative of said capacities and comparator means connected to receive said electrical signals and responsive to the signals being such as to indicate that said capacities differ by more than said predetermined amount to provide said output signal.

6. A coin testing apparatus according to claim 5, wherein said generator means is operative to generate said electrical signals in the form of pulses having widths proportional to said capacities that they represent.

7. A coin testing apparatus according to claim 6, wherein said generator means comprises, for each said electrode, a monostable circuit connected to the associated electrode such that the capacity between the electrode and the conductive member forms part of a timing network determining the pulse length of the monostable circuit.

8. A coin testing apparatus according to claim 7, wherein the monostable circuit comprises a resistor, a C/MOS gate having a first input connected to the associated electrode and a second input, said generator means further comprises means for supplying square waves of opposite phases to said first and second inputs of said gate, said first input being connected to said generator means via said resistor which cooperates with said capacity to constitute said timing network.

9. A coin testing apparatus according to claim 1, comprising a single magnetic core having therein an air gap, a coil wound on said core, an oscillator having a tuned circuit determining the operating frequency thereof, said coil forming part of said tuned circuit, whereby the disposition in said air gap of a coin of predetermined composition and thickness will cause a predetermined change in the frequency of said oscillator, and means responsive to said oscillator oscillating at the changed frequency to provide an output signal indicating that a coin of said predetermined composition and frequency is in said air gap.

10. A coin testing apparatus according to claim 1, comprising a further electrode disposed confronting and spaced from said first surface of said member of dielectric material whereby when a coin of predetermined thickness rests against said first surface the spacing between said further electrode and the coin, and therefore the capacitance between said further electrode and said planar conductive member, adopts a predetermined value, and means responsive to said capacitance adopting said predetermined value to provide an output signal indicating that a coin of said predetermined thickness rests against said first surface.

11. A coin testing apparatus comprising:

a member of dielectric material having a first surface against which, in use, a coin can rest;

at least two spaced electrodes disposed on a second surface of said member opposite said first surface and positioned such that when a coin of predetermined diameter rests against the first surface in a predetermined position a first of said electrodes will be opposite a position on the first surface within the periphery of the coin and a second of said electrodes will be opposite a position on the first surface outside of the periphery of the coin;

means for coupling a coin in said predetermined position to a reference potential; and capacitance monitoring means connected to said first and second electrodes and operative to monitor the capacities between said first and second electrodes and the reference potential and responsive to said capacities differing by more than a predetermined amount to provide an output signal indicating that a coin of said predetermined diameter is in said predetermined position.

12. A coin testing apparatus according to claim 11, wherein said means for coupling a coin in said predetermined position to a reference potential comprises means for capacitatively coupling the coin to the reference potential.

13. A coin testing apparatus according to claim 12, wherein said means for capacitatively coupling the coin to the reference potential comprises a planar conductive member which is at the reference potential and is arranged on said second surface of said member of dielectric material.

* * * * *